United States Patent [19]

Hayes

[11] Patent Number: 4,478,203

[45] Date of Patent: Oct. 23, 1984

[54] COMPOUND BOW CABLE AND BOWSTRING ATTACHMENT MEANS

[75] Inventor: Gerald G. Hayes, Gainesville, Fla.

[73] Assignee: Kidde Recreation Products, Inc., Northbrook, Ill.

[21] Appl. No.: 467,194

[22] Filed: Feb. 16, 1983

[51] Int. Cl.[3] ..... F41B 5/00

[52] U.S. Cl. ..... 124/24 R; 124/88; 124/DIG. 1

[58] Field of Search ..... 124/23 R, 24 R, 90, 124/DIG. 1, 25

[56] References Cited

U.S. PATENT DOCUMENTS

| | | | |
|---|---|---|---|
| 3,993,039 | 11/1976 | Groves et al. | 124/23 R |
| 4,054,118 | 10/1977 | McKee et al. | 124/23 R |
| 4,060,066 | 11/1977 | Kudlacek | 124/23 R |
| 4,078,538 | 3/1978 | Shepley | 124/23 R |
| 4,112,909 | 9/1978 | Caldwell | 124/23 R |
| 4,185,374 | 1/1980 | Shepley | 29/434 |
| 4,336,786 | 6/1982 | Mannon et al. | 124/23 R |
| 4,368,718 | 1/1983 | Simonds et al. | 124/23 R |
| 4,370,972 | 2/1983 | Stewart et al. | 124/23 R |
| 4,372,285 | 2/1983 | Simonds et al. | 124/90 |
| 4,401,097 | 8/1983 | Simonds et al. | 124/23 R |

*Primary Examiner*—Richard J. Apley
*Assistant Examiner*—William R. Browne
*Attorney, Agent, or Firm*—Emory L. Groff, Jr.

[57] ABSTRACT

A copound bow having low-rotation cams includes an improved anchor member adapted to releasably attach one end of both a bowstring and tension cable to each cam. The cams are formed with a main body or lobe joined to a secondary body or lobe and configured to provide an elongated throat therebetween with a planar cable/bowstring track or groove about the cam periphery. The opposed walls of the cam throat are configured to transversely or laterally receive the anchor member while precluding any longitudinal or radial displacement thereof as tension is applied to the cam member by the engaging ends of the bowstring and tension cable.

14 Claims, 5 Drawing Figures

COMPOUND BOW CABLE AND BOWSTRING ATTACHMENT MEANS

This invention relates generally to compound bows and more particularly to an improved manner of attaching the ends of the bowstring and tension cables to eccentrically mounted cam members at the limb tips of the bows.

As will be readily acknowledged by those skilled in the archery art, compound bows have become extremely popular during recent years. Such bows employ the use of eccentric pulleys, wheels or cams at the bow limb tips with the bowstring sheaved thereabout so that when the bow is drawn, the draw force initially rapidly builds up to its maximum designed limit and thereafter abruptly falls off as the bow is fully drawn. The purpose and advantage of such an operation are well known to those experienced in the art and need not be addressed herein.

The majority of compound bows employ a bowstring working in combination with a pair of crossing tension cables, with or without the addition of one or more pairs of intermediate pulleys or cams suitably affixed to the limbs and/or handle, intermediate each primary limb tip cam and the bow sight window. In many instances, the tension cables comprise two lengths of cable each having one of its ends joined to one of the two ends of the bowstring and thereafter passing around an adjacent limb tip pulley after which it crosses down or up to a point adjacent the opposite limb tip where it is suitably anchored. An example of such a type of compound bow will be found in the patent to Kudlacek U.S. Pat. No. 4,060,066 dated Nov. 29, 1977.

With such an arrangement as shown in the referenced example, each tension cable is slipped through the interior of a cam member with adjacent portions thereof sheaved about two laterally adjacent cam peripheries eccentric from one another. The distal portion of the tension cable is provided with an appropriate fixture member externally of the cam in order to provide for the releasable attachment of one end of the bowstring.

The foregoing manner of attaching a bowstring to a tension cable remote of the cam is quite popular in compound bows involving eccentric cam members describing an arc of over 180° of rotation during displacement of the bowstring from its brace height to its full drawn position. Actually, a substantial number of current models of compound bows employ cams or force multiplying means at their limb tips which are displaced at least 200° during use and many conventional multiple groove cams actually rotate about 250° as the bow is drawn from brace height to full draw.

With the present compound bow, a low rotation cam is utilized at each limb tip comprising a thin lightweight member defining a configuration suggestive of an irregular kidney-shaped member which is provided with a single, preferably continuous, peripheral track or groove disposed in a single vertical plane and within which one end of both a tension cable and the bowstring are sheaved. With this construction, a unique anchor member is provided for fixedly securing both the cable and bowstring ends within the elongated throat formed between the two lobes of the substantially kidney-shaped cam. The peripheral surface of the cam defining the elongated throat portion thereof is constructed in a manner to allow lateral or transverse insertion of the present anchor member after which, the longitudinal tension as constantly applied thereto by both the bowstring end and tension cable end, is resisted by the fixedly disposed anchor member. With the foregoing described construction, an archer can readily replace a worn bowstring having formed loops at its two ends, simply by relaxing the tension applied by the two bow limbs, whereupon the respective anchor members may be laterally withdrawn from their cams, after which the two looped portions of the bowstring are easily removed from the two anchor members and a replacement bowstring reinstalled by following the same procedure in reverse. In the same manner, either or both tension cables may be readily disconnected and replaced.

Accordingly, one of the objects of the present invention is to provide an improved compound bow cable and bowstring attachment means removably insertable in a low rotation cam member carried at each bow limb tip.

Another object of the present invention is to provide an improved compound bow cable and bowstring attachment means comprising a laterally insertable anchor member cooperating with the elongated throat formed between two lobes of a substantially kidney-shaped cam element.

Still another object of the present invention is to provide an improved anchor member for fixedly attaching the free ends of a tension cable and bowstring within the elongated throat area of a substantially kindey-shaped low rotation cam element.

A further object of the present invention is to provide an improved anchor member carried by an end of a tension cable adapted to engage the loop at the end of a bowstring following which the anchor member is laterally insertable within the elongated throat portion of a substantially kidney-shaped cam member.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawing.

Figure 1:
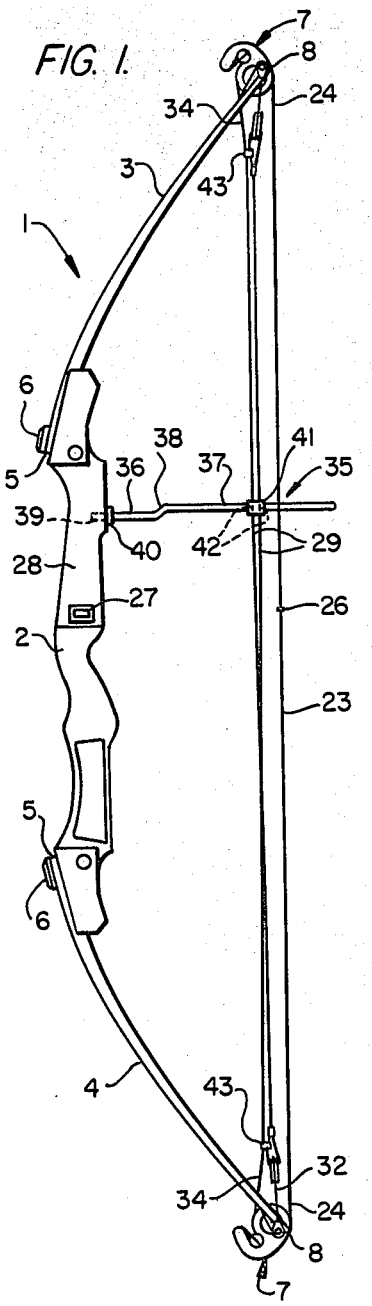
FIG. 1 is a side elevation of a compound bow utilizing the attachment means according to the present invention.

Referring now to the drawing, particularly FIG. 1, the present invention will be seen to relate to a compound bow, generally designated 1, including a central handle section 2 from which extend an upper limb 3 and lower limb 4. Although the specific configuration of the bow handle and limbs may substantially vary from that as shown in this drawing figure, the two limbs 3 and 4 preferably include an inner end 5 suitably adjustably attached to the two ends of the handle 2 so as to allow for regulation of the limb angle or tension as applied to the strung bowstring by the two limbs. In this respect, well known means comprising an adjusting element such as a cap screw 6 may be included to allow such limb adjustment.

Force-multiplying means, comprising a cam 7 is provided adjacent each bow limb tip 8 and these cams are pivotally mounted there at by means of a transverse pivot shaft 9 disposed through the body of each cam 7 and appropriately journaled adjacent the respective limb tips 8. As shown most clearly in FIGS. 2 and 3 of the drawing, each pivot shaft 9 may be carried by a pair of mounting blocks 10 attached to the relatively thin stock of the limb tip such that each cam 7 will be pivotally displaceable between a laterally opposed pair of such mounting blocks 10. To facilitate this arcuate displacement of the cam 7, the limb tip is centrally slotted as at 11.

The two cams 7 are of identical construction and will be understood to be merely inverted with respect to one another when attached to the upper limb 3 or lower limb 4 and thus, a description of one cam will obviously apply to the other cam. Each cam comprises a relatively thin planar member defining a generally irregularly kidney-shaped configuration and will be seen to include a main body or lobe 12 joined to a secondary body or lobe 13 by means of an intermediate body 14. The continuous periphery 15 of the cam is provided with a preferably uninterrupted track or groove 16 with the hook shaped secondary body or lobe 13 including a bowstring portion 17 while the main body or lobe 12 includes a tension cable portion 18. The opposed portions **15*a*, 15*b* of the cam periphery, on the secondary body and main body respectively, will be seen from FIGS. 4 and 5 of the drawing to clearly define an elongated throat or channel T terminating in a base or bottom 19 formed by the cam intermediate body 14. The distance between the two opposed cam lobes defining the elongated throat T will be understood to be restricted in that area more distant from the throat base 19 and this relationship is insured by the formation of opposed relief areas, cut-outs or recesses 20, 21 respectively in the cam peripheries 15*a*, 15*b*, with these recesses 20, 21 located adjacent the elongated throat base 19. To minimize the weight of the pivotal cams 7, each main body 12 may be formed with an enlarged cut-out or opening 22** or otherwise perforated to reduce the mass of displaceable material carried at the limb tips.

Before discussing the details of the construction of the present attachment or anchor member in relation to the above described cams 7, the bowstring and tension cable members will be described as included on the compound bow 1 of FIG. 1. The bowstring, generally designated 23 preferable comprises a unitary element spanning the two opposed cams 7—7 and includes a bowstring end segment 24 adjacent each cam 7 terminating in an anchor portion 25 which preferably comprises a loop as most clearly shown in FIGS. 3 and 4. The medial stretch of the bowstring 23 may include a nocking point indicator 26 appropriately vertically positioned with respect to the bow handle arrow shelf or an arrow rest 27 provided in the handle sight window 28.

Each of the two tension cables 29—29 includes an end portion 30 suitably pivotally affixed adjacent one cam 7 and its respective bow limb tip 8. This attachment may assume any well known construction but preferably comprises an arrangement insuring disposition of all portions of all cables substantially along the bow centerline axis during its use. In this respect, an appropriate bridle mechanism is preferred such as the illustrated attachment member 31 supported within the cradle or cable loop 32 which in turn has its respective ends affixed to the same pivot shaft 9 supporting the cams 7. In this manner, the end portion 30 of each tension cable 29 may be suitable affixed directly to the attachment member 31 or looped therethrough as shown most clearly in FIG. 2 at 33.

The opposite end of each tension cable 29 is stretched across to the opposed cam 7 and includes a tension cable cam segment 34 sheaved about the tension cable portion 18 of the cam groove or track 16.

From the foregoing, it will be appreciated that since the two cams include vertically disposed co-planar tracks 16 mounted along the vertical center axis of the bow, and all portions of the two tension cables 29—29 as well as the bowstring 23 are disposed in a manner spanning the two spaced apart cam tracks 16, then it will be appreciated that all components deflected or displaced during use of the bow will at all times remain aligned with the vertical center axis thereof. This construction is highly desirable in a compound bow in order to preclude twisting of the limbs or the application of uneven forces thereupon.

The medial stretches of the two tension cables 29 may alternatively be slightly off-set to one side of the arrow axis through the bow sight window 28 in order to eliminate any interference between the tension cables and an arrow shaft and fletching and in this respect, a tension cable deflector 35 as shown in FIG. 1 of the drawing may be removably attached to the bow handle section 2. The deflector includes an attachment segment 36 adjacent the bow handle and a cable segment 37 joined thereto by an off-set portion 38. A convenient manner of securing the deflector 35 comprises providing a tapped bore in the handle section 2 adapted to cooperate with a threaded portion 39 on the end of the deflector attachment segment 36 and which cooperates with appropriate lock means such as a nut 40. In this manner, the deflector is secured in a selected angular disposition whereby the lateral distance of the cable segment 37 may be varied with respect to the vertical plane of the two tension cables 29. During the draw of the subject bow, the two tension cables will be understood to be vertically displaced while at the same time, the horizontal spacing therebetween varies a minor amount.

In any bow used for hunting, the problem of noise occuring during the release of the bowstring and arrow is always of concern since game will be startled by such noise before arrival of the released arrow. To assist in minimizing any such noise, a tension cable guide member 41 of lubricous material such as plastic, is slidably carried upon the deflector cable segment 37 and includes two separate vertical tension cable passages 42—42 which serve to slightly laterally retain the medial stretch of the tension cables away from the path leading to the sight window 28 while at the same time dampening vibrations and noise as produced by the tension cables when the full drawn bowstring 23 is released. Additionally, in this same connection, it is proposed that plastic E-clips 43, each containing two vertically disposed passageways, be applied about each tension cable end portion 30 and the adjacent cam segment 34 of the other tension cable, in the area of the attachment member 31 associated with each cam.

Figure 2:
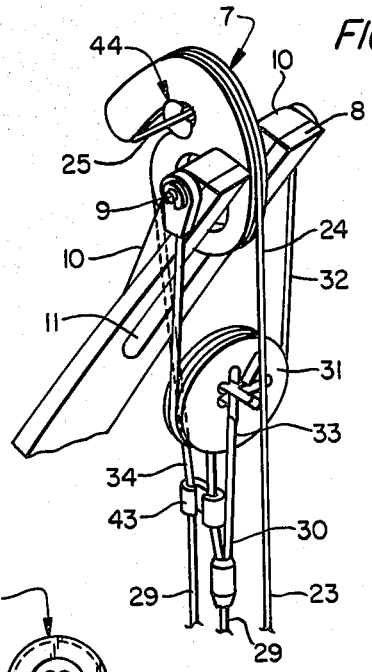
FIG. 2 is a partial top perspective view of the upper limb tip area of the bow of FIG. 1.
Figure 3:
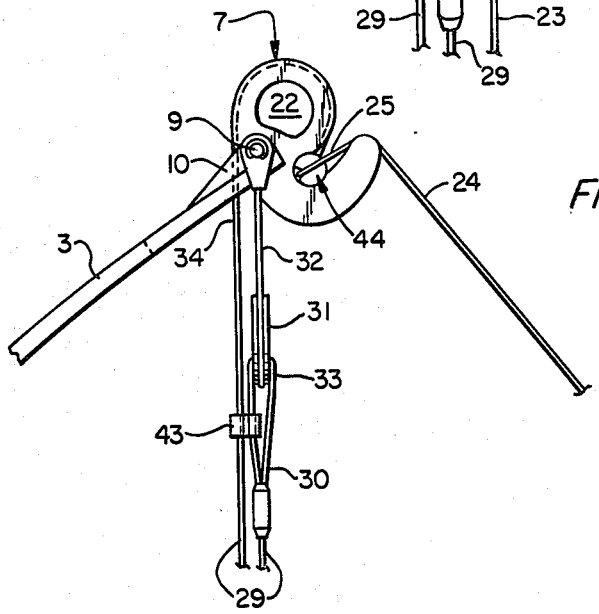
FIG. 3 is a partial enlarged side elevation illustrating the anchor member as it appears with the bow in full drawn position.
Figure 4:
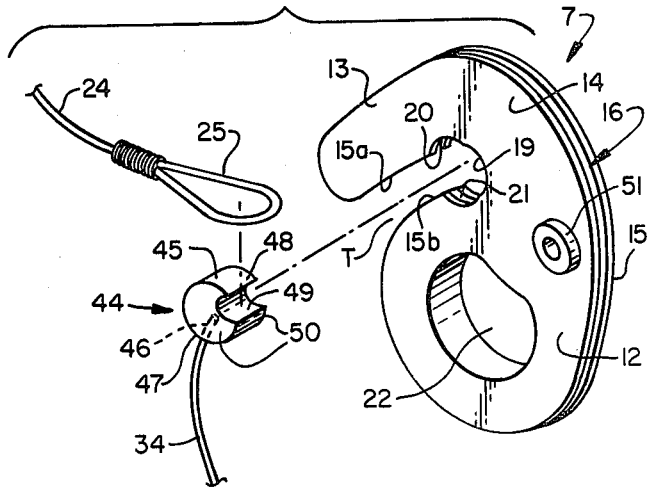
FIG. 4 is an exploded perspective view illustrating the manner of assembly of the anchor member adapted to secure the end of a bowstring and a tension cable to the cam member.
Figure 5:
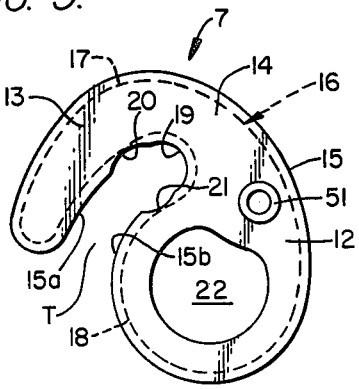
FIG. 5 is an enlarged side elevation of the cam adapted to cooperate with the anchor member of this invention.

The attachment means for securing the cable and bowstring ends at each cam 7 is shown in the assembled or attached condition in FIGS. 1, 2 and 3 and its application and removal from either cam is shown in the exploded view of FIG. 4 of the drawing. In these figures, it will be seen that the attachment means comprises an anchor member 44 having a thickness no less than the thickness of the cam 7 and which is provided with a substantially circular periphery 45. The distal portion 46 of each tension cable cam segment 34 is preferably permanently affixed relative the outer face 47 of the anchor member 44 such as by casting each anchor member 44 about one of the tension cable distal portions 46. The opposite or inner face 48 of the circular anchor member will be seen to include a transverse groove or recess 49 adapted to receive the endmost portion of the bowstring anchor loop 25. Thus, when assembling a new tension cable or bowstring as shown in FIG. 4 of the drawing, a bowstring end loop 25 is wrapped about the two side walls 50—50 of the anchor member 44 with the end of this bowstring loop seated within the anchor member transverse groove 49 following which the thus assembled components are laterally shifted into the inner area of the cam elongated throat 18 at a point immediately spaced from the bottom 19 thereof. This assembly procedure is facilitated by the two partially circular or arcuate relief areas 20–21 formed in the peripheral portions 15*a*, 15*b* of the elongated throat 18. Thus, it follows that the relief portions 20–21 are configured to provide a close sliding mating fit with the circular periphery 45 of the anchor member 44 and with this construction, the assembled anchor member and its attached tension cable and bowstring are precluded from any longitudinal, radial or outward displacement from the cam throat T since the remaining space between the opposed main body 12 and secondary body 13 of the elongated throat T is less than the diameter of the installed anchor member 44.

The assembly or disassembly of the subject anchor member 44 is readily accomplished by relaxing the tension as applied by the respective bowstring 23 and tension cables 29, 29. This may be obtained by means of any suitable known bow compressor device or in the case of a bow having adjustable limbs 3–4, by merely loosening the limb tension adjustment elements 6—6 a sufficient amount to cause the two bow limb tips 8—8 to move toward one another whereupon all tension applied to the two anchor members 44 by their respective bowstring and tension cables will be relaxed. Conversely, following installation of the anchor members 44, the limbs 3 and 4 are returned to their normal use position. It is this very tension existing in a properly strung bow, that maintains the present anchor members 44 in the installed position since it will be appreciated that at all times the cam segment 34 of the two tension cables as well as the bowstring end segments 24 are both sheaved within the single, planar cam track 16 and apply a constant outward pulling force upon the anchor members, which force is resisted by the necked-down configuration offered by the cam elongated throats T.

The low rotation feature of the present cam 7 is achieved by the unique double lobe construction and formation of distinct profiles for both the bowstring and tension cable portions of the cam track 16. With this arrangement, each cam will be seen to rotate about its eccentric bushing 51 approximately 180° from the braced condition of FIG. 1 to the full draw position of FIG. 3.

I claim:

1. In a compound bow having a pair of limbs attached to a handle section, an eccentrically mounted cam attached to each limb and provided with a continuous periphery, a track in said periphery, a bowstring and a pair of tension cables spanning the bow limbs, the improvement comprising: each said cam including main and secondary lobes of dissimilar configuration spaced apart to define an elongated throat therebetween formed by opposed portions of said cam periphery, a bowstring anchor member transversely insertable within said throat, means on the periphery of said throat formed by the opposed portions restraining said inserted anchor member from displacement from said throat radially along a path which lies within the plane of said cam, said tension cables each having a terminal cam segment, said bowstring having opposite end segments, means joining one said tension cable cam segment to one said anchor member, and anchor member means permitting the removable connection of one said bowstring end segment to said anchor member when said anchor member is remote from said cam throat whereby, when said tension cable cam segment and bowstring end segment are respectively joined and connected to said anchor member and said anchor member subsequently transversely inserted into said throat, said bowstring and tension cables are precluded from independent planar displacement relative to said cam.

2. A compound bow according to claim 1 wherein, said cam track is substantially continuous about said cam periphery.

3. A compound bow according to claim 1 wherein, said track includes a tension cable portion on said cam main lobe extending from said throat and encompassing a substantial portion of said main lobe periphery.

4. A compound bow according to claim 1 wherein, said track includes a bowstring portion on said cam secondary lobe extending from said throat and encompassing a substantial portion of said secondary lobe periphery.

5. A compound bow according to claim 1 wherein, said anchor member includes a generally circular periphery and said restraining means comprises an arcuate recess in each said periphery opposed portion.

6. A compound bow according to claim 1 wherein, said cam includes an intermediate body between said main and secondary lobes, said throat provided with a bottom formed by said periphery of said intermediate body and said restraining means disposed adjacent said throat bottom.

7. A compound bow according to claim 1 wherein, said tension cable cam segment joining means includes a distal portion on said cable cam segment embedded within said anchor member.

8. A compound bow according to claim 1 wherein, said bowstring end segment connecting means includes a loop portion on said bowstring end segment and said anchor member provided with a recess engaged by said loop portion.

9. A compound bow according to claim 1 wherein, each said cam periphery generally defines a figure "6" configuration and said cams rotate less than 200° as said bowstring is drawn from brace height to full draw.

10. A compound bow according to claim 1 wherein, said tension cable includes an end portion opposite said cam segment, means attaching each said end portion to one said limb and clip means slidably confining each said end portion with a stretch of the other of said tension cables.

11. A compound bow according to claim 1 including, a deflector element extending from said handle section past said pair of tension cables, means on said deflector element adjustable to vary the lateral position of said deflector element relative the normal vertical disposition of said tension cables and said deflector element provided with guide means slidably receiving said tension cables and laterally displacing them relative the vertical disposition of said bowstring.

12. A compound bow according to claim 5 wherein, the radius of said anchor member periphery substantially corresponds with the radius of said arcuate recesses whereby a close mating fit is provided as said anchor member is transversely inserted into said cam throat.

13. A compound bow according to claim 8 wherein, said cam includes an intermediate body between said main and secondary lobes, said throat provided with a bottom formed by said periphery of said intermediate body, said anchor member including a generally circular periphery bounded by two side walls, opposite inner and outer faces on said anchor member periphery, said inner face juxtaposed said throat bottom, and said anchor member recess transversely disposed in said inner face.

14. A compound bow according to claim 13 wherein, the axial dimension of said anchor member between said two side walls substantially corresponds to the thickness of said cam.

* * * * *